US006384309B1

(12) United States Patent
Lellingson

(10) Patent No.: US 6,384,309 B1
(45) Date of Patent: May 7, 2002

(54) WOODWIND CASE

(76) Inventor: Larry L. Lellingson, 521 W. Tudor Rd., Anchorage, AK (US) 99503

( * ) Notice: Subject to any disclaimer, the term of this patent is extended or adjusted under 35 U.S.C. 154(b) by 0 days.

(21) Appl. No.: 09/392,298

(22) Filed: Sep. 8, 1999

(51) Int. Cl.[7] ..... G10G 1/00
(52) U.S. Cl. ..... 84/453; 206/314
(58) Field of Search ..... 84/352, 453; D17/99, D17/10; 206/314

(56) References Cited

U.S. PATENT DOCUMENTS 270,640 A * 1/1883 Cundy ..... 206/314
1,664,476 A * 4/1928 Geib ..... 206/314
1,888,927 A * 3/1932 Lang ..... 206/314
1,900,718 A * 3/1933 Lang ..... 206/314
1,988,718 A * 1/1935 Cook et al. ..... 206/314
4,190,152 A * 2/1980 Reiter ..... 206/314

* cited by examiner

*Primary Examiner*—Robert E. Nappi
*Assistant Examiner*—Kim Lockett
(74) *Attorney, Agent, or Firm*—Robert M. Wolters

(57) ABSTRACT

A clarinet and a flute of the woodwind family are provided with a case that holds the instrument firmly in position. The part of the case that opposes the instrument has a plurality of projections to close and hold closed all normally open keys when the case is closed, so that pressure on all of them is similar, so that there will be no malformation of keys or operating members. Thus, all keys will open and close as they are supposed to and the instrument will remain in good playable condition for a very long time. Although the invention is explained with regard to clarinets and flutes, it applies equally to all members of the woodwind family.

6 Claims, 5 Drawing Sheets

WOODWIND CASE

BACKGROUND OF THE INVENTION

It has for some time been recognized woodwind instruments fresh out of the case do not play properly. Not all notes begin and end at the same time. This is more noticeable to those skilled in the art than it is to players of less experience. It has been observed that this is partly due to bends, however slight, in the operating mechanisms for the keys. I have observed that the instruments do not fit snugly in the cases and bang around a bit as they are moved, and consequently, some of the key operating mechanisms are slightly or grossly bent.

OBJECTS AND SUMMARY OF THE INVENTION

I have noticed from a close study of woodwind instruments that some universal cases are among the great majority of those used. They are called universal because everything of the kind of instrument they are supposed to hold is supposed to fit in the case. That is, every clarinet should fit the case, every flute should fit the case, and so on with the entire family of woodwinds. It is necessary that the woodwind fit the case precisely, and I have further observed that when they are in the case, woodwinds must have all the keys closed as the keypads are shaped by their engagement with the keyholes in the body of the instrument. Many of the keys are not closed with the case closed, and it occurs to me, as a band instrument repairman, that all of the keys should be closed, and those that are normally open are high on the priority list of keys that should be closed by a uniform pressure.

Accordingly, it has occurred to me that there should be projections on the inside of the case engageable with the operating levers for the keys that are normally open so that the keys will be closed fully when the case is closed, thereby avoiding bends being formed of even the slightest degree.

It is an object of the present invention to provide a case for woodwinds which has projections in the lining of the case which are of the proper size to close and hold closed all of the keys that are normally opened.

THE DRAWINGS

The invention will be best understood from the following description when studied in accompaniment with the supporting drawings wherein.

DETAILED DESCRIPTION OF THE ILLUSTRATED EMBODIMENT

Figure 1:
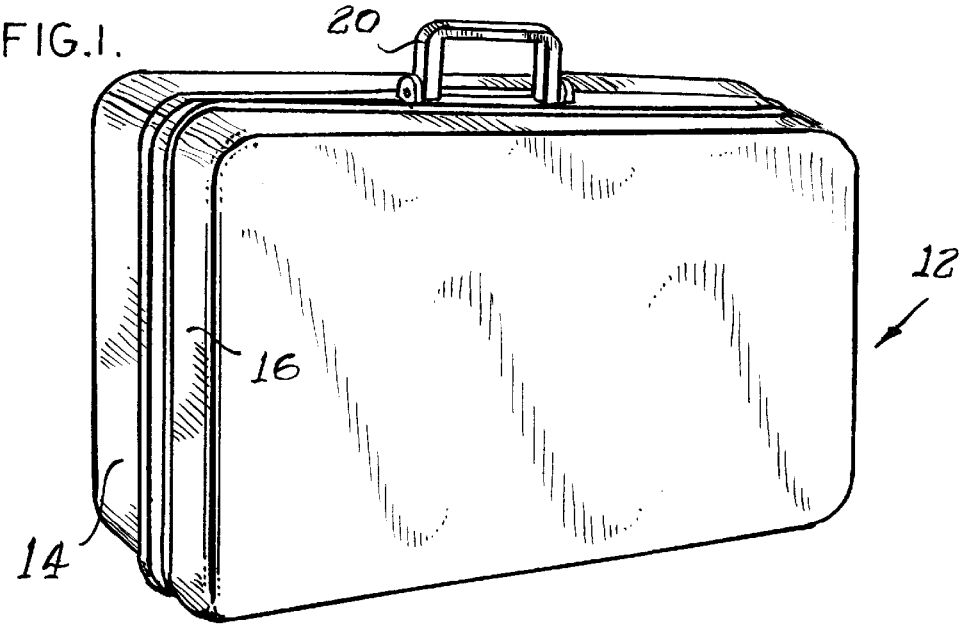
FIG. 1 is a perspective view of a clarinet case.
Figure 2:
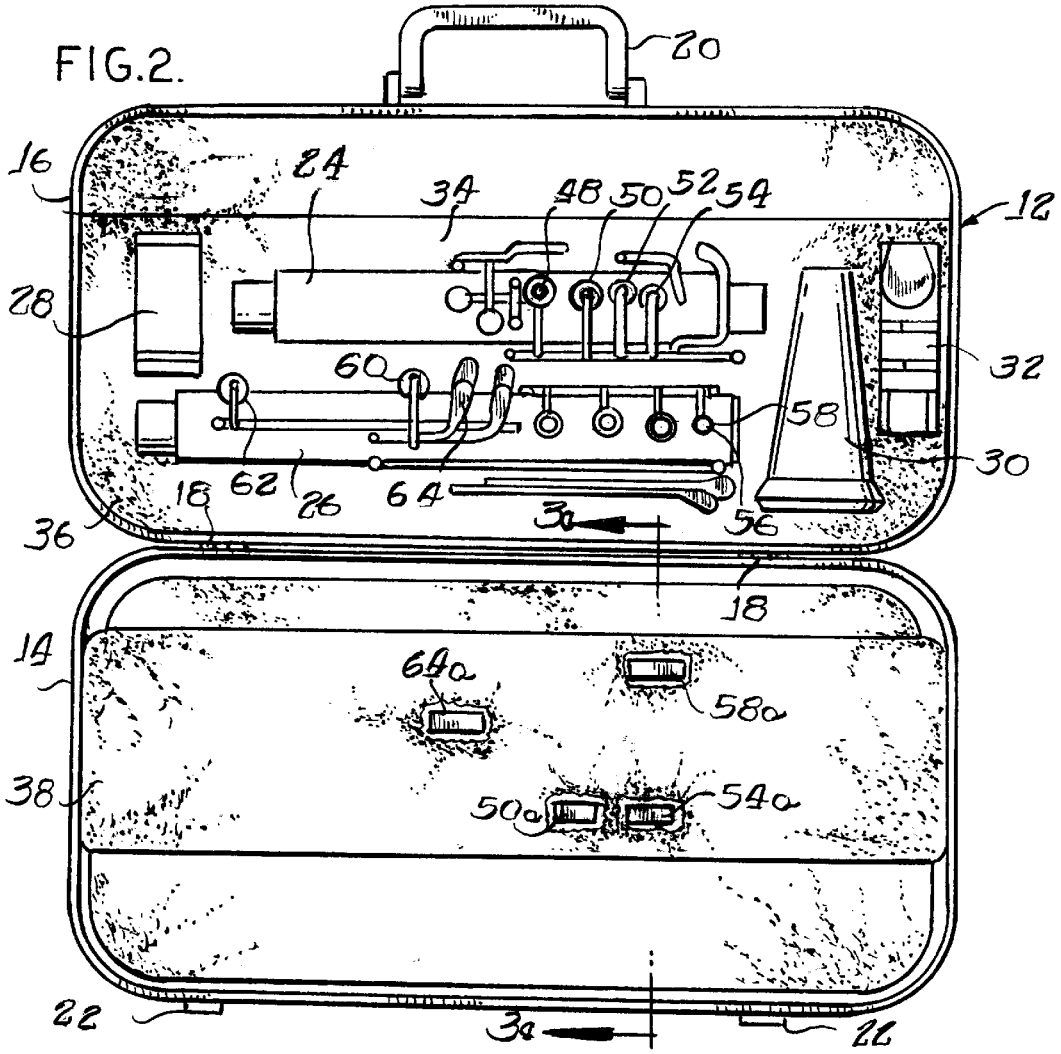
FIG. 2 is a plan view of the opened case of FIG. 1.
Figure 3:
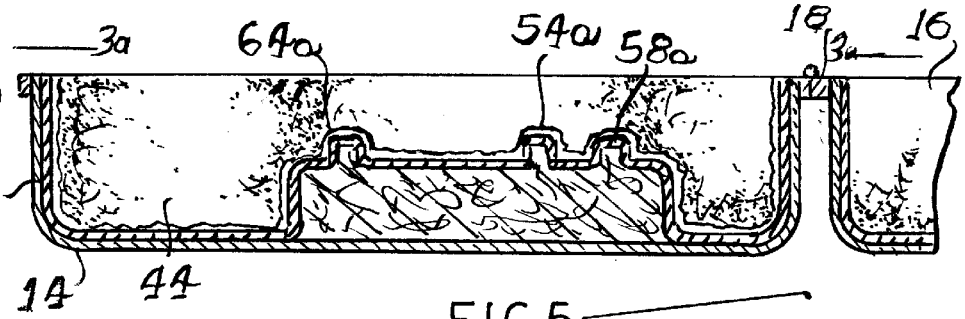
FIG. 3 is a sectional view taken through the case along the line 3—3 as shown in FIG. 2.

FIGS. 1 and 2 show a clarinet case 12 having a clarinet case having upper 14 and lower 16 halves interconnected by hinges 18. A handle 20, preferably pivoted, on the upper half of the case for carrying it. Buttons 22 are provided on the upper half of the case for sliding to release slidable catches.

The upper half 16 of the case is provided with a lining which is sculpted to receive the upper and lower halves or parts of the clarinet body. The upper and lower parts of the clarinet are respectively numbered 24 and 26. The upper half of the case is also sculpted to receive smaller parts of the clarinet, such as the neck 28, the bell or the horn 30, and the mouthpiece 32. Further, a divisional wall 34 upstands from the bottom of the case and accepts minor parts of the clarinet such as reeds, cleaning parts, and a harp to hold music when the clarinetist plays in a marching band. The sculpting may be of a dense type of polyurethane, or it may be of the molded or pressed steel material. The entire surfaces of upper part 34 and the lower part of the clarinet case are finished with a cloth such as a plush or knotted to avoid scratching the clarinet. Aside from the fact that the case is molded closely to accommodate the parts of the clarinet, the greatest difference resides in the provision of the four parts of the steel lining of the case that upstand from the lining 40. The lower part of the case also has a steel lining 40 to back the molded polyurethane 46 or other material which serves to press the two parts (and smaller parts) of the clarinet into the sculpted upper half of the case to keep the parts of the clarinet from rolling about in the case during transport.

There are only five key-closure members on a clarinet that normally are in open position, and that must be held closed by the projections. Fortunately, there are only four controls that close all of the closure members. These five closure members are moved to a closed position by a variety of movements of the keys. However, only those which are necessary to close the key members are listed, and they are listed by numbers rather than the notes to be played so that those not skilled in the art of clarinets will understand it. There are a plurality of extending members connected to the key closure members in the usual fashion of clarinets with the plurality of key closure members, as by soldering on the key extending members, respectively, or by soldering them onto extention members.

The first closure member that must be closed member 48, and it is closed by depression of the ring key 50 which is immediately next to it. The next key closure member that is opened, and must be closed and must be closed during closure of the case is identified as 52, and is closed when ring key 54 is depressed. These are on the upper part of the body 24.

The remaining keys which must be closed are on the lower part of the body, as are the operating members. The first of these four is closure member 56, and it is closure of the ring key 58 immediately adjacent to it. It is also closed by the next two ring keys, but that is incidental. The final two open holes that must be closed are those that are closed by key pads 60 and 62, and these are both closed by depression of key 64. As noted, there are other ways of closing the keys, but only the four keys noted need be considered.

As noted heretofore, there are four projections visible with the ring keys in the upper body, 54 and 50, and the projections that close these two are identified by similar numerals with the addition of the lowercase a for consistency, and the consistency is continued in the lower part of the body by projections 58*a* and 64*a*. The projection for closing the keys are shown as sheet steel. However, it may be necessary to avoid any, in which case they can be cylinders of solid aluminum with no sacrifice in weight saving.

Figure 5:
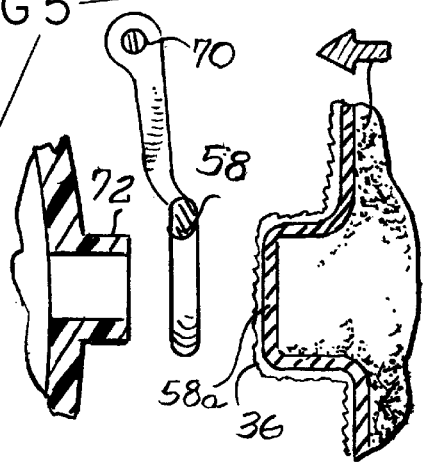
FIG. 5 is a view along the line 5—5 in FIG. 2 just as the case is being closed.
Figure 4:
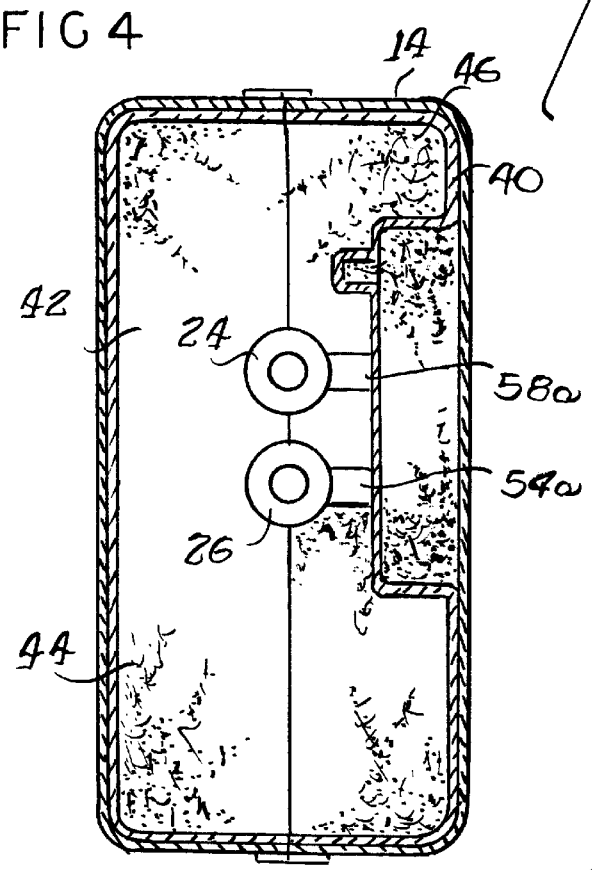
FIG. 4 is a view through the closed case taken along the line 4—4 showing how the projections close and hold closed the normally open keys.
Figure 6:
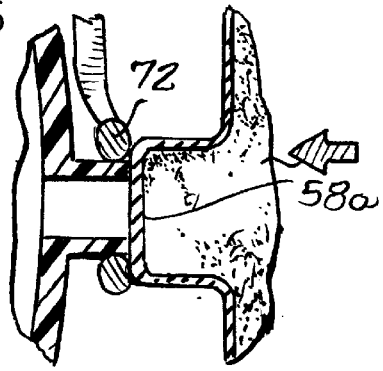
FIG. 6 is a view similar to FIG. 5 after the case has been closed.
Figure 7:
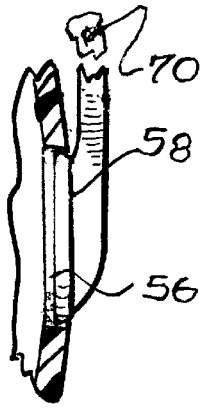
FIG. 7 is a view of a key displaced from the key in FIG. 5 and 6, showing the keypad on its opening taken generally along the line 7—7 in FIG. 2.

Attention should now be directed to FIGS. 5–7 for a showing of the operation of projections. The ring key 58 is engaged by closure member 58*a* with a thin layer of cloth 36 fitting between them so as not to mark the ring key, and the ring key is on the same shaft 70 as is key-closure member 56. Accordingly, depression of key closure member 58*a* on ring 72 pivot shaft 70 will pivot key closure member down to key closing position on its hole.

Although the invention has been explained with regard to a clarinet, it should be equally clear with regard to other members of the woodwind family. There will be different projections in different places to bear on key closure members, and thus to close, and to hold closed, all normally open keys, to hold them closed when the case is closed.

Other variations will doubtless be apparent to those skilled in the art, as should whether the projections will be hollow or solid. It further will be understood that the projections may be of any cross section, so long as they will depress a ring key.

The lower half of the case has built-in compartments 134 to receive the three sections of the instrument (the body 136, the foot joint 138, and the head joint 140). Also there is a compartment for the cleaning rod 142.

The upper half of the case has a thin layer of padding 122, and both sections of the case are covered with cloth for appearance and protection of the instrument. The case is made of wood; however, they may be constructed of plastic or metal.

Figures 8, 9:
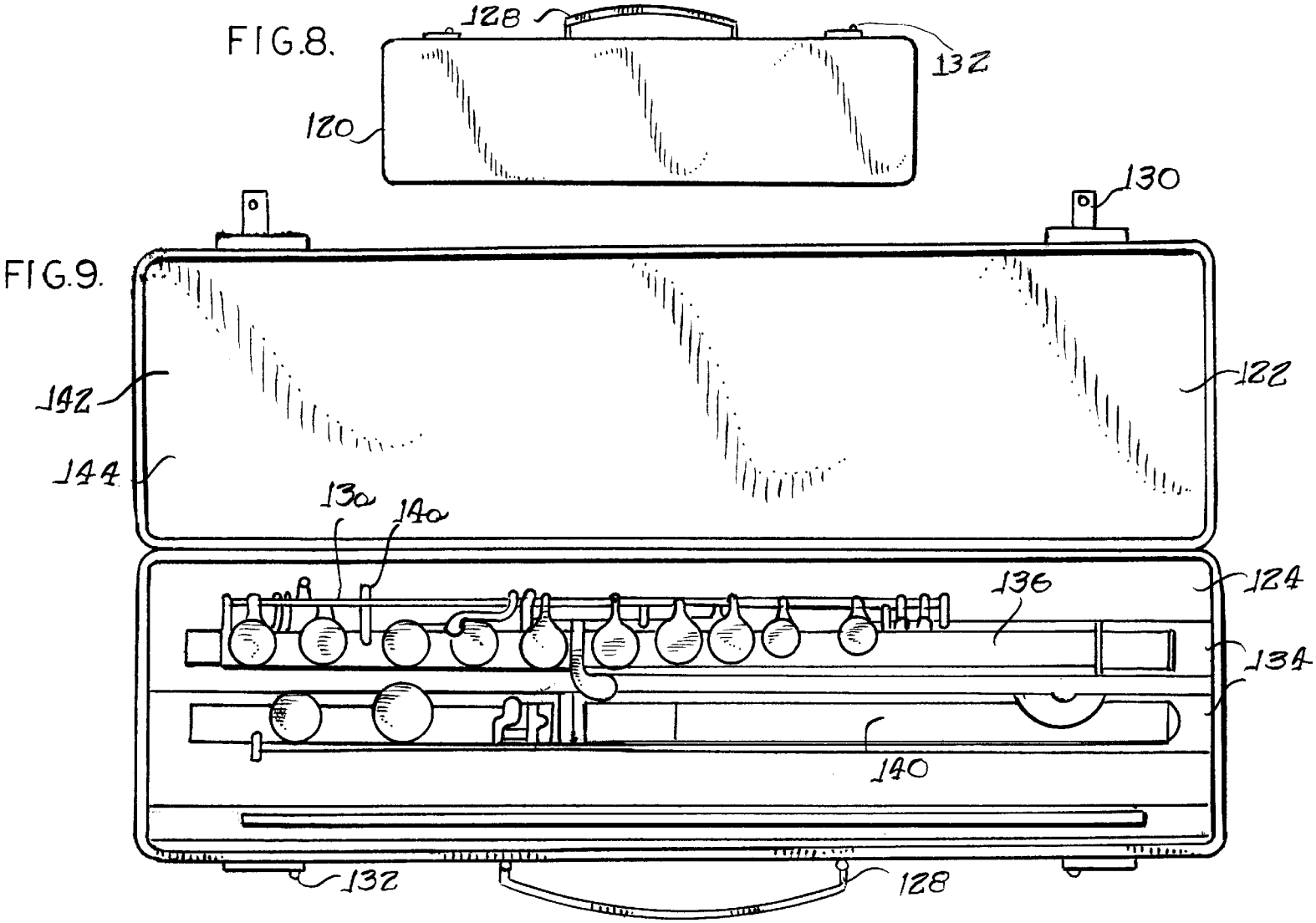
FIG. 8 is a side view of a flute case.
FIG. 9 is a plan view of an open case FIG. 8.
Figure 11:
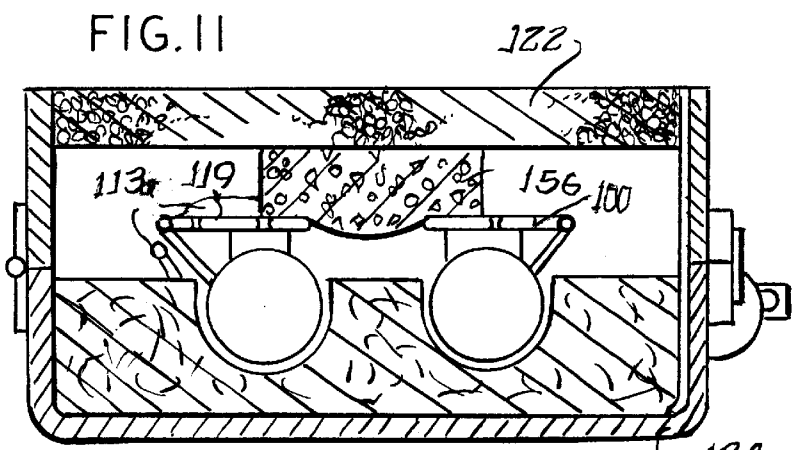
FIG. 11 is a side view of a closed case with the side removed and showing the effect of the insert on the keys.

A typical student model flute has twelve key cups 150 with pads 148 in them (Fig. 8) which are held open by needle springs 149, that need to be closed and held closed by inserts 156 and 158 on their respective tone holes 146. The remaining four keys 13–16 are listed only for reference and only need to be avoided by the inserts. Additional keys or levers which open and close the key cups have correlating numbers with a lower caption "a" for consistency.

The intricate workings of the flute or the delicate adjustments necessary which make the instrument perform properly are not addressed in this description. They are incidental except for the fact the key cups move up and down in precise locations on the instrument. This movement is accomplished by rod 160 inserted inside of the key tube 164 and attached to posts 162, as in FIGS. 12 and 14. All key cups are hinged in such a manner.

Figure 10:
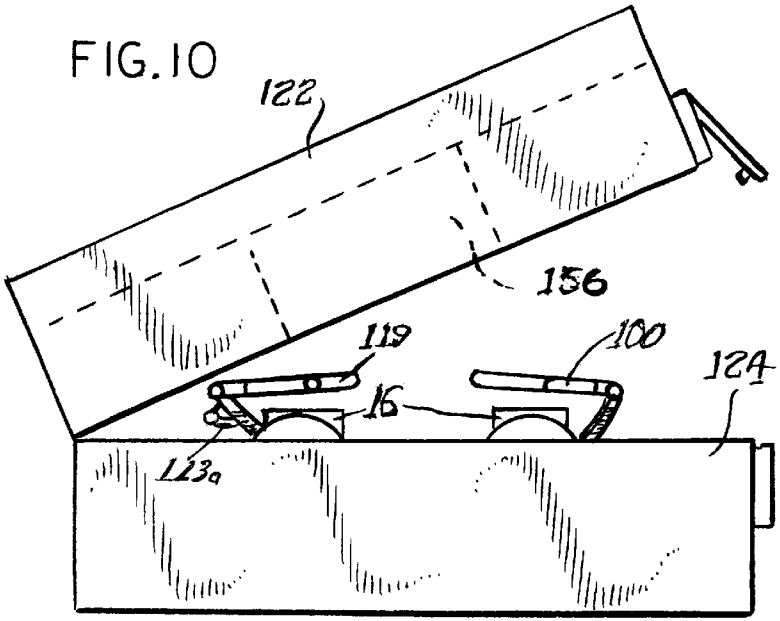
FIG. 10 is a side view of a partially opened case.

The pad 148 is held inside of the key cup 150 by a snap-in 152, which is attached to a spud 154 inside of the key cup (FIG. 10).

The flute is designed in such a way that only two inserts are necessary to be installed and attached to the case to close and hold closed all twelve of the open key cups on the instrument.

Figure 13:
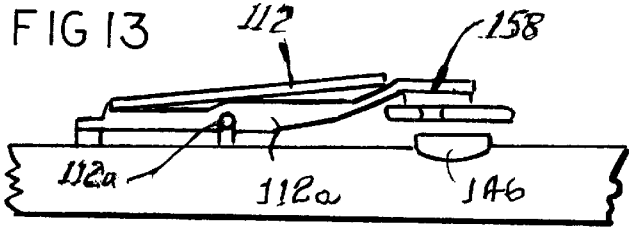
FIG. 13 is a side view of an open key 12.
Figure 12:
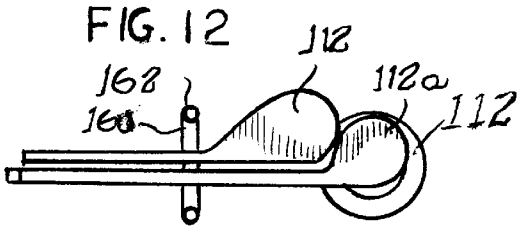
FIG. 12 is a top view of key 12.
Figure 16:
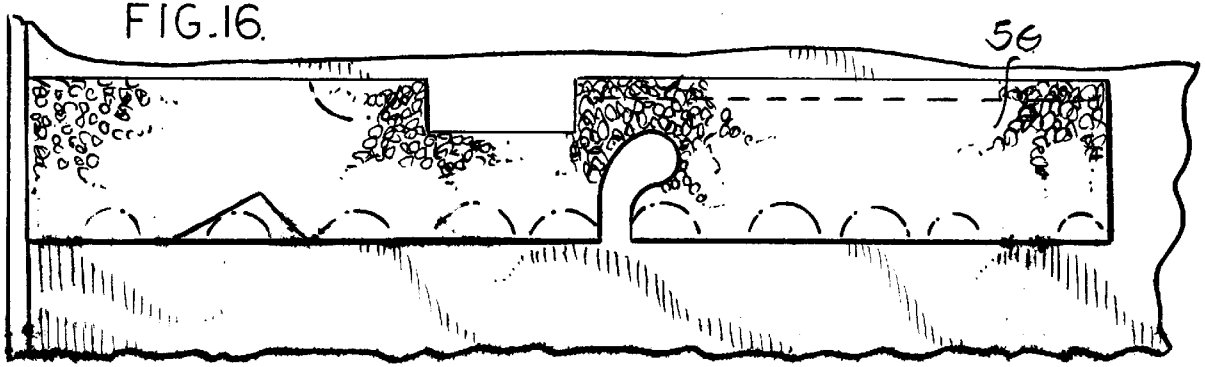
FIG. 16 is an extensive view of an open case with the instrument and the inserts in their proper locations.
Figure 17:
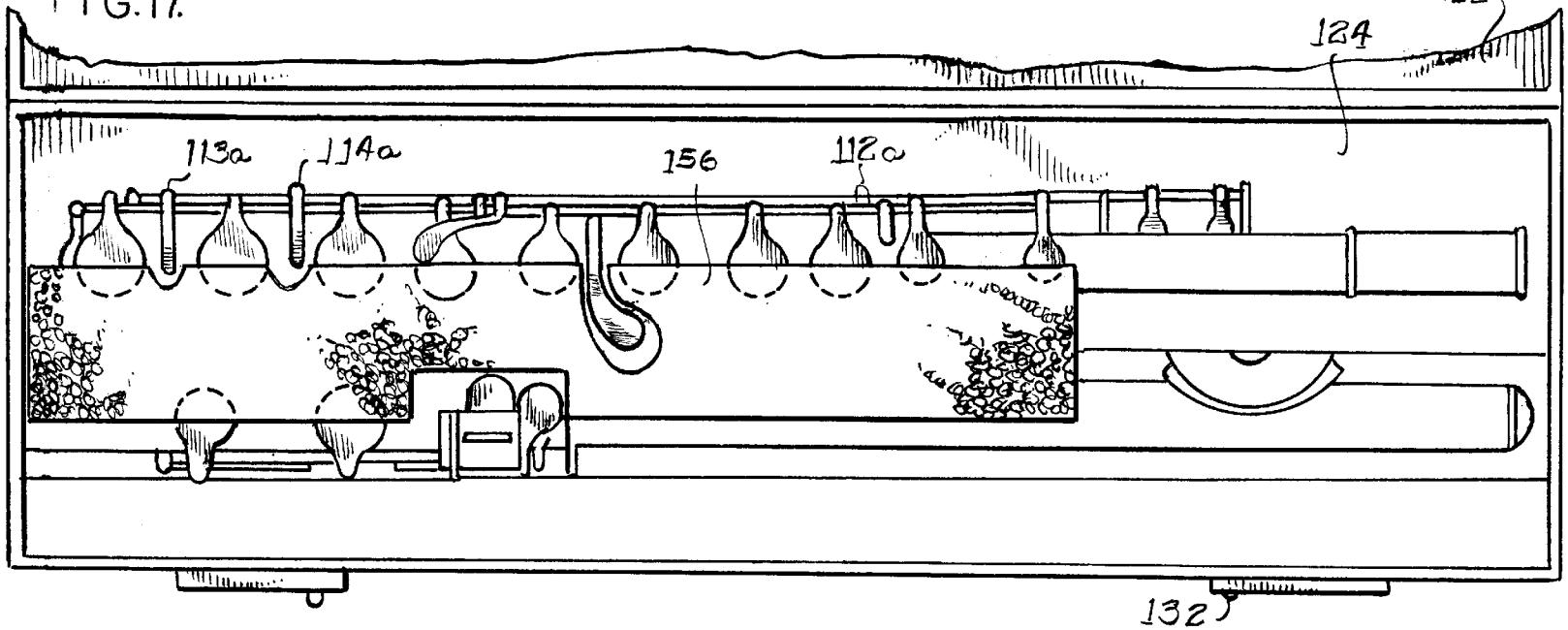
FIG. 17 is a flute insert with pressure points and cut-outs indicated.

The first insert 156 is attached to the upper half of the case and will close key cups 1–11. The second insert is attached to the inside of the flute body compartment in association with the twelve keys in the lower half of the case. This key will close automatically when the instrument is placed into the case (FIGS. 12, 13, and 14).

Figure 14:
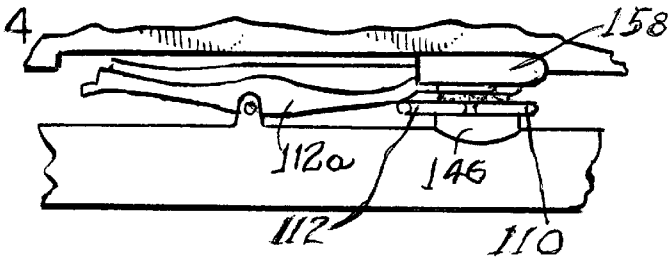
FIG. 14 is a side view of a closed key 12 and the insert, which holds it closed.
Figure 15:
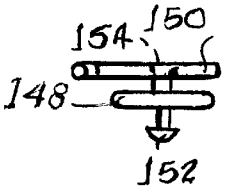
FIG. 15 shows how a pad is attached to a key cup.

FIG. 10 shows where the pressure will be applied on their respectively numbered key cups, and FIG. 14 shows how it will operate when the case is closed and locked.

A complete specification has now been presented and the rest will be clear to those skilled in the art. Various changes will occur to those skilled in the art and will become apparent to those skilled insofar as the claims can be read on them. In any case, the inserts may be made of metal, plastic, or very dense foam, whether rubber or plastic.

Resume

A clarinet and a flute of the woodwind family are provided with a case that holds the instrument firmly in position. The part of the case that opposes the instrument has a plurality of projections to close and hold closed all normally open keys when the case is closed, so that pressure on all of them is similar, so that there will be no malformation of keys or operating members. Thus, all keys will open and close as they are supposed to, and the instrument will remain in good playable condition for a very long time. Although the invention is explained with regard to clarinets and flutes, it applies equally to all members of the woodwind family.

The invention is claimed as follows:

1. The combination including a musical woodwind instrument and a case therefore, said woodwind instrument including a plurality of key closure members, said key closure members being moved from key closure blocking the of air through the holes, and a plurality of extending members respectively connected to said key closure members to force said key closure members into key closing position upon closing of said case and for holding said key closure members in key closing position while said case remains closed, said key closure members being returned to key open position by appropriate spring members connected between said key closure members and said case to to have said closure members to proper key closure position where they are closed.

2. The combination as set forth in claim 1 wherein said case has protrusions engageable with said extending members as said case is closed to move said key closure members to key closing position.

3. The combination as set forth in claim 1 wherein moving of said key closure members into key closing position shapes the position of all of the key closure members into key closing position.

4. The combination set forth in claim 2 wherein all of said protrusions are rigid.

5. The combination set forth in claim 4 wherein all of said protrusions are rigid with said case and move with said case as said case is moved to key closing position.

6. The combination as set forth in claim 1 wherein said extending members are respectively connected to devices rotateable to force all of said keys to key closure position.

* * * * *

UNITED STATES PATENT AND TRADEMARK OFFICE

CERTIFICATE OF CORRECTION

PATENT NO. : 6,384,309 B1
DATED : May 7, 2002
INVENTOR(S) : Larry L. Lellingson

It is certified that error appears in the above-identified patent and that said Letters Patent is hereby corrected as shown below:

Title page,
Item [12], "Lellingson" should read -- Ellingson --
Item [76], "Larry L. Lellingsoni" should read -- Larry L. Ellingson --

Signed and Sealed this

Twentieth Day of May, 2003

JAMES E. ROGAN
*Director of the United States Patent and Trademark Office*